United States Patent [19]

Kochey, Jr.

[11] 4,403,571

[45] Sep. 13, 1983

[54] BOILER WITH ECONOMIZER HEAT ABSORPTION REDUCTION

[75] Inventor: Edward L. Kochey, Jr., Colebrook, Conn.

[73] Assignee: Combustion Engineering, Inc., Wilson, Conn.

[21] Appl. No.: 328,893

[22] Filed: Dec. 9, 1981

[51] Int. Cl.[3] ..... F22B 33/00

[52] U.S. Cl. ..... 122/1 A; 122/1 B

[58] Field of Search ..... 122/1 A, 1 B, 1 C, 406 S, 122/451 S

[56] References Cited

U.S. PATENT DOCUMENTS

| | | | |
|---|---|---|---|
| 2,582,830 | 1/1952 | Hawley | 122/1 A |
| 2,744,733 | 5/1956 | Howes | 122/1 A |
| 2,795,213 | 6/1957 | Cooper | 122/1 A |
| 2,867,182 | 1/1959 | Crites | 122/1 A |
| 3,818,872 | 6/1974 | Clayton, Jr. et al. | 122/406 S |
| 4,029,027 | 6/1977 | Smith | 110/347 |
| 4,223,640 | 9/1980 | Rochford et al. | 122/1 A |

*Primary Examiner*—Henry C. Yuen

*Attorney, Agent, or Firm*—Edward J. Kochey, Jr.

[57] ABSTRACT

The steam generator includes means for limiting the heat absorption of the economizer 28 during start-up and low load operation. An air bypass duct 54 is located to convey air from cold air duct 46 at a location between forced draft fan 44 and air heater 40 to the gas duct 38. The air is introduced upstream of economizer 28 where it mixes with hot flue gases to reduce the temperature of gas flowing through the economizer. Control dampers 56 are operated to maintain the desired temperature at the economizer outlet 30.

2 Claims, 1 Drawing Figure

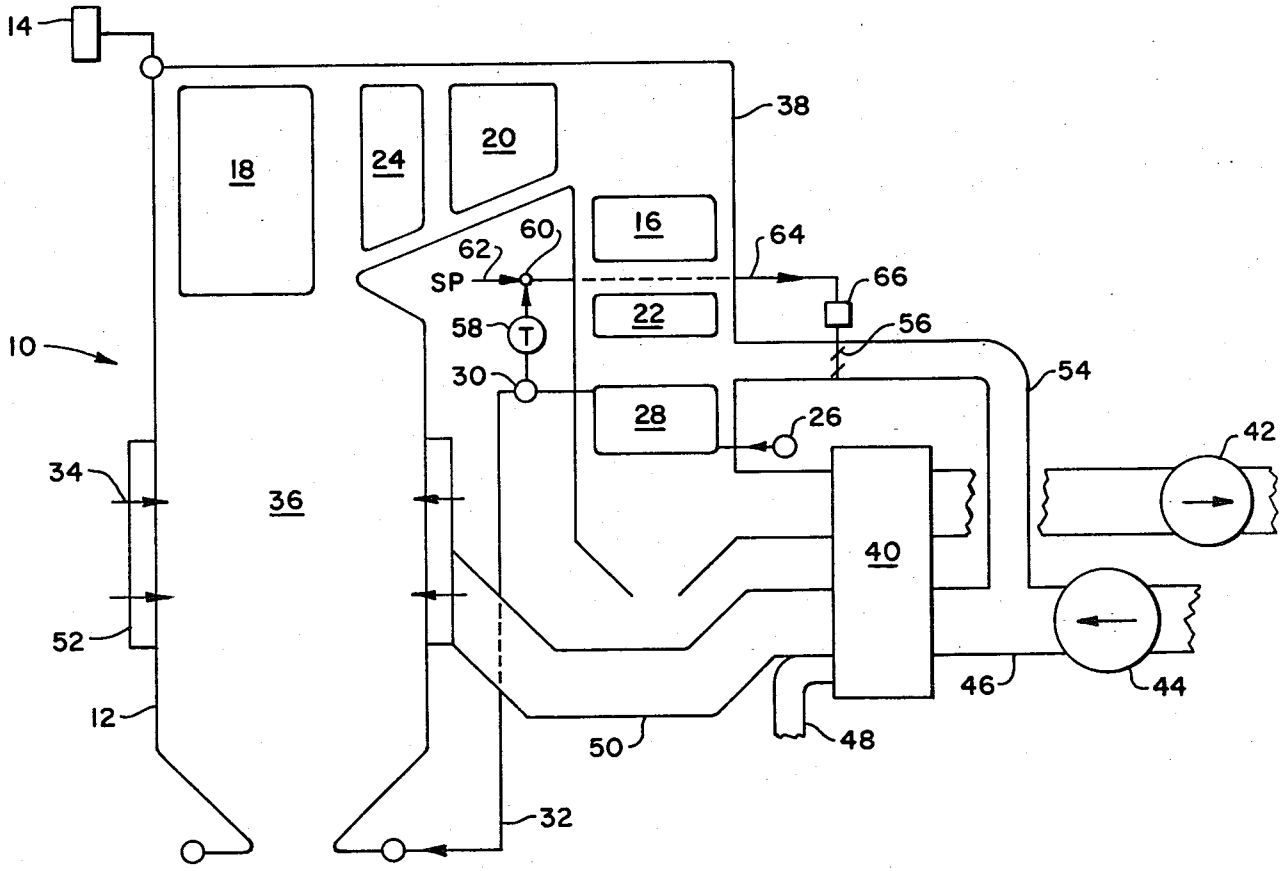
42
44
54
46
40
48
66
56
26
38
64
16
22
28
50
60
20
62
SP
58
30
32
24
36
18
14
10
34
52
12

BOILER WITH ECONOMIZER HEAT ABSORPTION REDUCTION

BACKGROUND OF THE INVENTION

The invention relates to steam generators and in particular to an apparatus for limiting economizer heat exchange during start-up and low load operation.

On steam generators used for rapid start-up, the heavy firing leads to considerable heat transfer to the water in the economizer. When the unit is at subcritical pressures during this time, the overheating results in the formation of steam in the economizer. Where the economizer flow is carried to a steam drum, this results in water hammer while where the flow is introduced directly into waterwall circuits, as in a once-through unit, this produces a problem of distributing a two-phase mixture of water and steam.

One solution has been to increase the feedwater flow to the extent that steam is not formed. This requires additional blowdown capacity in the unit to discharge the excess feedwater flow. Where a motor driven start-up feed pump is used, this may exceed the capacity of the pump. It also requires additional deaerating steam to deaerate the excess flow. Furthermore, any tolerance which is applied in the saturation temperature increases the heat absorption duty of the furnace since more water must be heated up to saturation; and this amount includes not only the water that is desired to be evaporated but the excess flow as well.

A gas bypass duct around the economizer would decrease the economizer heat absorption and thereby avoid steaming. This duct must be designed to handle hot, dust-laden gas and must operate in that atmosphere. It is difficult to maintain properly-operating and tightly-sealed dampers in such an environment.

Furthermore, the only pressure difference available for passing the gas through the bypass duct would be the draft loss of the remaining gases through the economizer (and through the gas side of the air heater if the duct also bypasses the air heater) thereby requiring a large duct.

Another possible approach on steam generators having recirculation through the furnace walls is to recirculate some of the saturated water from the steam drum through the economizer. This raises the economizer water temperature and lowers the log mean temperature difference between the gas and the water. This tends to reduce the heat absorption but has an upper limit on the ability to avoid steaming, this limit, of course, being a function of the pressure and the concomitant saturation temperature.

SUMMARY OF THE INVENTION

A steam generator has an air bypass duct located to extract air between the forced draft fan and the air heater. The duct discharges air to the gas duct at a location downstream of the steam heating surface but upstream of the economizer. This cold air decreases the temperature of the gases passing over the economizer thereby reducing the heat absorption thereof.

Controllable dampers are located in this bypass duct and operated in response to the water temperature leaving the economizer for the purpose of avoiding economizer steaming during start-up and during low load operation.

BRIEF DESCRIPTION OF THE DRAWING

FIG. 1 is a schematic illustration of a steam generator showing the location and controls for the cold air bypass.

DESCRIPTION OF THE PREFERRED EMBODIMENT

The invention is shown as applied to a steam generator 10 which is of the once-through type and intended to start-up on sliding pressure operation with steam formed in waterwalls 12 and separated in steam separator 14. The generated steam passes through steam heating surfaces 16, 18, and 20, passes to a steam turbine, not shown, and is reheated through steam heating surfaces 22 and 24.

Feedwater enters economizer inlet header 26 passing through economizer 28 to economizer outlet header 30. It thereafter passes through line 32 into the tubes of the furnace wall 12.

Fuel is fired through burners 34 into furnace 36 with the gas passing upwardly through the furnace and out through gas duct 38. The steam heating surfaces are located within this duct, as is economizer 28 which is located downstream of the steam heating surface with respect to gas flow. The gas passes outwardly through air heater 40 and induced draft fan 42 to a stack, not shown.

Combustion supporting air is brought in through forced draft fan 44 and air duct 46 to air heater 40. Hot air duct 48 carries hot air through the pulverizers while hot air duct 50 carries hot air to windbox 52. It is introduced into the furnace 36 as combustion supporting air.

During rapid start-up of such a steam generator, the furnace is heavily fired; and the heat transfer characteristics are such that heat transfer in the economizer 28 is sufficiently high to not only heat the feedwater up to saturation temperature but to generate steam. This steam at that location tends to create water hammer problems and steamwater flow distribution problems. Accordingly, it is desired that the heat absorption through economizer 28 be controllably reduced without detrimental effect on the remaining portions of the steam generator.

Bypass duct 54 is connected to air duct 46 at a location between the forced draft fan 44 and the air heater 40. It is also connected to the gas duct 38 at a location between the steam heating surface 22 and the economizer 28. Dampers 56 located within the duct are operable to control the flow therethrough. The pressure differential available to force the air through this bypass duct includes the air heater pressure drop on the cold air side, the windbox losses, the control damper losses between the windbox and the furnace, and the draft loss overall of the steam heating surface. Accordingly, substantial pressure differential is available to cause air to flow through duct 54 and this bypass duct may be of relatively small size. Furthermore, by throttling the windbox dampers beyond normal operation, even more draft loss can be obtained if required.

This cold air entering the gas stream upstream of the economizer 28 reduces the temperature of the gas by direct mixing and thereby decreases the heat absorption of economizer 28. Temperatures sensor 58 senses the temperature of the water leaving economizer 28 and convery a signal to comparison point 60. This temperature indication is compared with a set point temperature 62 to determine an error signal which passes through control line 64.

The set point temperature 62 is varied during start-up to establish a temperaure level slightly below saturation temperature for the pressure of the steam generator at the particular moment. The control signal passing through control line 64 enters controller 66 which modulates the dampers 56 to remove the error signal. Modulation of the dampers changes the cold air flowing into the gas duct upstream of the economizer thereby controlling the economizer outlet temperature below the saturation temperature.

The forced draft fan is sized for full-load operation and since the described operation is only required during start-up and low load operation, there is substantial excess capacity in that fan to handle any required air flow, and sufficient head available to handle a substantial draft loss should it be required. The bypass duct need only to be designed to carry cold air which is free from fly ash loading. No high temperature dampers are required.

I claim:

1. A steam generator arrangement comprising: a furnace; a gas duct connected to said furnace for carrying flue gas therefrom; steam heating surface located within said gas duct; an economizer heating surface located within said gas duct at a location downstream of said steam heating surface with repsect to gas flow; a forced draft fan; an air duct connected to said forced draft fan and said furnace for conveying air to said furnace; an air heater in heat exchange relationship between gas flowing through said gas duct and air flowing through said air duct at a location in said air duct downstream of said fan and in said gas duct downstream of said economizer; a bypass duct connected to said air duct between said fan and said air heater and connected to said gas duct at a location upstream of said economizer and downstream of said steam heating surface; and controllable dampers located within said duct, whereby air is introduced through said bypass directly upstream of said economizer.

2. A steam generator as in claim 1 comprising also: sensing means for measuring temperature of feedwater leaving said economizer; and means for controlling said dampers in response to said sensing means.

* * * * *